United States Patent [19]

Schosek

[11] 3,988,004

[45] Oct. 26, 1976

[54] DRIVE JAWS FOR A PIPE AND ROD PUSHER DEVICE

[76] Inventor: William O. Schosek, P.O. Box 3626, North Fort Myers, Fla. 33903

[22] Filed: Sept. 22, 1975

[21] Appl. No.: 615,533

Related U.S. Application Data

[63] Continuation-in-part of Ser. No. 482,275, June 24, 1974, Pat. No. 3,907,253.

[52] U.S. Cl. ..... 254/29 R

[51] Int. Cl.[2] ..... E21B 19/00

[58] Field of Search ..... 254/29 R

[56] References Cited

UNITED STATES PATENTS

| | | | |
|---|---|---|---|
| 2,882,011 | 4/1959 | Ripstein | 254/29 R |
| 3,022,042 | 2/1962 | Orcutt | 254/29 R |
| 3,645,502 | 2/1972 | Stromp, Jr. | 254/29 R |
| 3,807,695 | 4/1974 | Gremillion et al. | 254/29 R |

*Primary Examiner*—Al Lawrence Smith
*Assistant Examiner*—Robert C. Watson
*Attorney, Agent, or Firm*—Alfred E. Wilson

[57] ABSTRACT

This invention pertains to the drive jaw structure of a device for installing a pipe under a finished surface such as a driveway or street. The drive jaws are each provided with a spring loaded shift lever and a slide bar; one end of the spring is anchored to a slide box structure, carrying the jaw assembly, and the opposed spring end is slidably engaged on the slide bar in a manner whereby proper manipulation of the shift lever will cause the associated drive jaw to be selectively shifted and maintained in a forward or reverse drive attitude.

Both of the drive jaw assemblies are pivotally maintained in position relative to the slide box by means of a single removable rod, extending centrally, longitudinally of the top of the slide box.

6 Claims, 7 Drawing Figures

DRIVE JAWS FOR A PIPE AND ROD PUSHER DEVICE

This is a continuation-in-part of my copending patent application entitled "Pipe Guide Means for a Rod and Pipe Pusher", Ser. No. 482,275, filed June 24, 1974, now U.S. Pat. No. 3,907,253, issued Sept. 23, 1975.

BACKGROUND OF THE PRESENT INVENTION

To install a pipe under a finished surface such as a driveway or street, for example, it is routine procedure to provide operating and target trenches on opposed sides thereof. The pipe or rod pusher device, replacing the bucket on a standard tractor-mounted hydraulic backhoe, is properly located in the operating trench by the boom mounted dipper stick of the backhoe. After the pusher device is properly positioned and braced for the pushing operation, a first rod length is manually inserted through a pair of drive jaws and drivingly engaged thereby to push said first rod length under the street or driveway. The trailing end of the first rod length is provided with a coupling to receive a second rod length whereupon the hydraulic drive means is reactivated to push the second rod forwardly toward the target trench. A sufficient plurality of rod length are similarly attached to preceeding rods until the leading tip end of the first rod length emerges into the target trench.

The leading tip end is threadably provided with a pusher cap which is then removed and replaced with an adaptor for attachment to the end of a pipe to be permenantly installed under the above surface; said pipe being so installed by reconditioning the bracing means and drive jaws to reverse the direction of movement to pull the pipe back through the hole formed by the rod until the leading end thereof, coupled to the rod, emerges into the operating trench.

The above described device and operation thereof is quite conventional, however, certain deficiencies and difficulties are encountered in the operation of the reversable drive jaws and replacement thereof when necessary because of wear.

To reverse the direction of drive, it is necessary to reverse the pitch or angle of inclination of each drive jaw relative to the push rod. Each jaw has an upper transverse rod, pivoted relative to the driven slide box, with a lever arm, fixed thereto as by welding. The jaw is held in either a forward or reverse drive attitude relative to the push rod by means of a tension spring extending between a fixed position to the slide box at a first end thereof, and a second end which is selectively attached to the shift lever either above or below the axis of the jaw pivot rod. Heretofore, to reverse the direction of drive, it has been necessary for an operator of the device to physically remove the second end of the tension spring from one end portion of the jaw lever and to reattach said second end relative to a second lever end portion.

The device of the present invention incorporates a slide bar, fixed relative to each jaw lever and extending above and below the axis of the jaw pivot rod. The second end of the tension spring is slidably engaged on the slide bar. When the lever is manually pivoted between the two drive positions, the second end of the tension spring will automatically slide along the slide bar to the slide bar end portion which is the closer to the fixed first spring end. This occurs because of the inherent tension forces of the spring.

It has been common practice to pivotally mount the jaw pivot rods through a pair of opposed side walls of the slide box assembly. Because of the wear factor on the gripping jaws, it is necessary to periodically replace said jaws. With the conventional structure it has been necessary to remove the entire slide box assembly from the device and to disassemble the slide box to remove the worn jaws for replacements. The slide box must then be completely reassembled and replaced in the device.

The pivot rods of the pair of drive jaws of the present invention are pivotally engaged in aligned pairs of top notches in the opposed side walls of the slide box and are pivotally maintained in place by a single, longitudinal, centrally disposed, removable keeper rod which is slidably engaged relative to the top of the slide box and said pivot rods. The keeper rod is normally maintained in position by a lock clip. To replace the drive jaws, the lock clip and keeper rod are removed with the slide box in place in the device. The worn drive jaws are lifted from the top slots and replaced by new jaws and the keeper rod and lock clip are replaced. Therefore, it can be seen that the complete jaw replacement operation can be accomplished in a matter of minutes whereas this operation has conventially been a long, laborious task.

OBJECTS AND ADVANTAGES OF THE PRESENT INVENTION

One of the principal objects of the present invention is to provide a pair of drive jaws for a pipe or rod pusher device, each of which may be shifted to and maintained in either a forward or reverse drive attitude by manual actuation of a single shift lever.

Another principal object of this invention is to provide slide bar means, fixed relative to each shift lever, and a tension spring leaving a first end, fixed relative to a slide box assembly, pivotally carrying the drive jaws, and a second end, slidably engaged along the slide bar in a manner so as to maintain the drive jaw in a forward or reverse drive attitude as determined by the position of the shift lever.

A further object of the instant invention is to provide a transverse pivot rod, fixed relative to each drive jaw and shift lever, which is rotatably journaled in aligned notches formed in the respective top edges of a pair of opposed side walls of the slide box.

Yet another object of the present invention is to provide a removable, centrally, longitudinally extending keeper rod, carried by the slide box, to facilitate quick removal and replacement of the drive jaws.

DETAILED DESCRIPTION OF THE DRAWINGS

Figure 1:
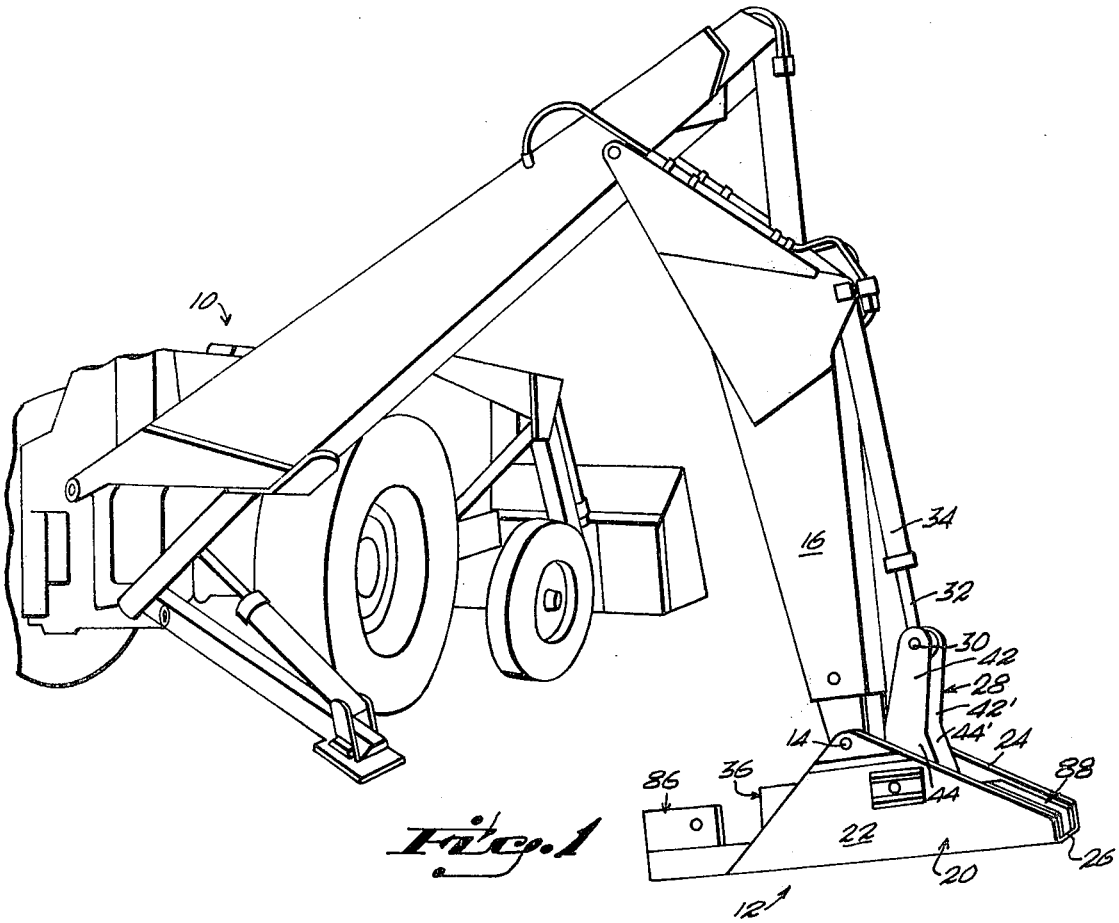
FIG. 1 is a perspective view of a standard tractor-mounted hydraulic backhoe machine with a pipe pusher, embodying the present invention, attached to the dipper stick thereof.
Figure 2:
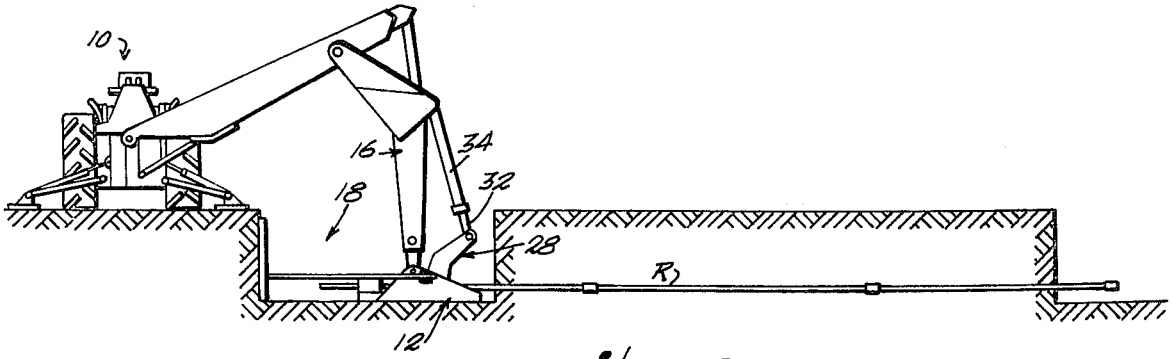
FIG. 2 is a schematic view illustrating the pushing operation.
Figure 3:
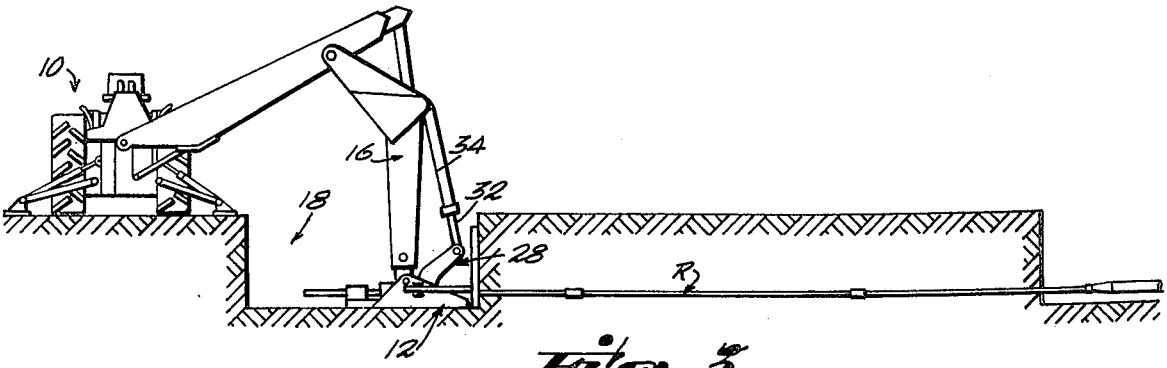
FIG. 3 is a schematic view illustrating a pipe attached to the leading end of a rod in position to be pulled back through the hole formed by the rod.

With reference to the drawings in which like reference characters designate like or corresponding parts throughout the various views and with particular reference to FIG. 1, a standard tractor-mounted hydraulic backhoe machine is designated generally at 10 with a pipe and rod pusher device 12 pivotally attached at 14 to the end of the dipper stick 16 in a conventional manner. The pusher device 12 replaces the backhoe bucket and utilized the backhoe hydraulics for movement thereof into an operating trench 18 as well as in performing the rod and pipe pushing operations.

A typical pipe and rod pusher device includes a generally channel shaped main body portion 20 comprised of upstanding, generally triangularly shaped, opposed side walls 22 and 24 connected by a bottom wall 26. A power lever arm 28 is pivotally attached at 30 to the outer end of a piston rod 32 of a hydraulic cylinder 34 to impart reciprocating movement to the lever arm 28 and a slide box assembly, 36, slidably engaged along the bottom wall 26. A pair of drive jaws assemblies 38 and 40, FIGS. 4 through 7, are pivotally carried within the slide box 36 and engage a pipe or rod R, as illustrated in the drawings.

Figure 4:
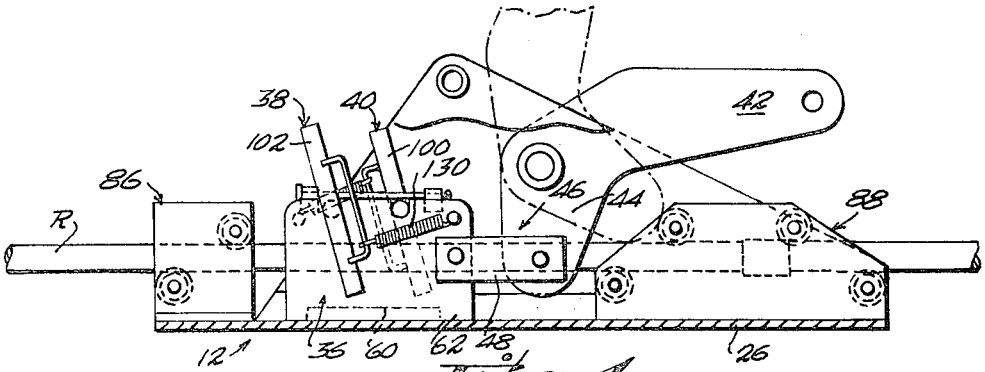
FIG. 4 is a side elevation view of one form of pipe and rod pusher device, partially shown in section to illustrate the drive jaw assembly of the present invention.
Figure 5:
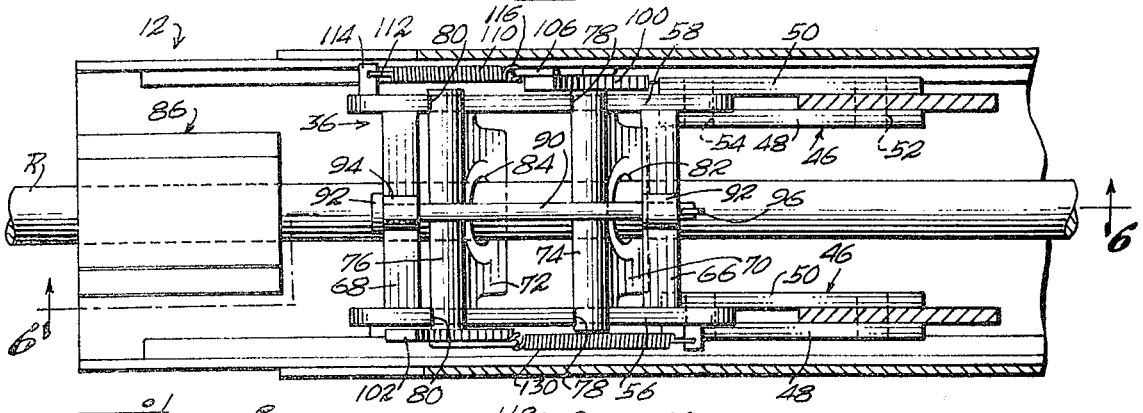
FIG. 5 is a top plan view of the device of FIG. 4.

With reference to FIG. 4, the power lever arm 28 is in the form of a bell crank, providing a first lever arm portion 42, pivoted to the piston rod 32 at 30 and a second lever arm portion 44 pivotally linked at 46 to the slide box 36. As illustrated in FIGS. 1 and 5, the bell crank lever 28 is formed of two identical, spaced apart fixed members providing first lever arms 42, 42′ and 44, 44′.

Identical pairs of links 48 and 50 are pivotally connected at their first ends to lever arm 44, 44′ as at 52, and at their second ends are pivotally connected at 54 to the respective rear end portions of a pair of upstanding, spaced apart side walls 56 and 58 of slide box 36. The slide box 36 is formed of side walls 56 and 58, a bottom wall 60, fixed between the bottom edge portions 62 and 64 of said side walls 56, 58 and front and back transverse connecting bars 66 and 68 fixed between the front and back top edge portions of the respective side walls 56, 58.

When the bell crank lever 28 is reciprocated by the operation of piston rod 32, back and forth reciprocating movement along the bottom wall 26 is imparted to the slide box 36 by means of the bell crank arms 44, 44′ and the pairs of pivot links 48, 50.

A pair of spaced apart, front and back drive jaw members 70 and 72 are transversely, pivotally carried by the slide box side walls 56 and 58 between the front and back connecting bars 66 and 68. Transverse pivot rods 74 and 76 are rigidly fixed relative to the top edges of the respective drive jaws 70 and 72 and are rotatably journaled in respective pairs of transversely aligned notches 78—78 and 80—80 formed in the top edge portions of the slide box side walls 56 and 58.

The drive jaws 70 and 72 are provided with central through holes 82 and 84 which are enlarged relative to the diameter of the rod R passing therethrough in a conventional manner. Front and back guide means indicated generally at 86 and 88 are provided to align and guide the rod R relative to the jaw holes 82 and 84. The guide means 86 and 88 form no part of the present invention and are not shown in detail.

Figure 6:
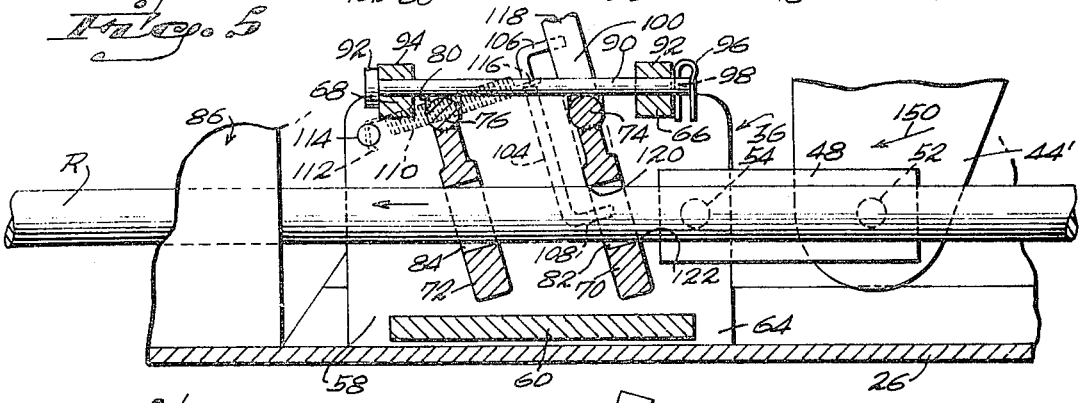
FIG. 6 is longitudinal sectional view taken substantially along the line 6—6 of FIG. 5, illustrating the drive jaws in a first position.
Figure 7:
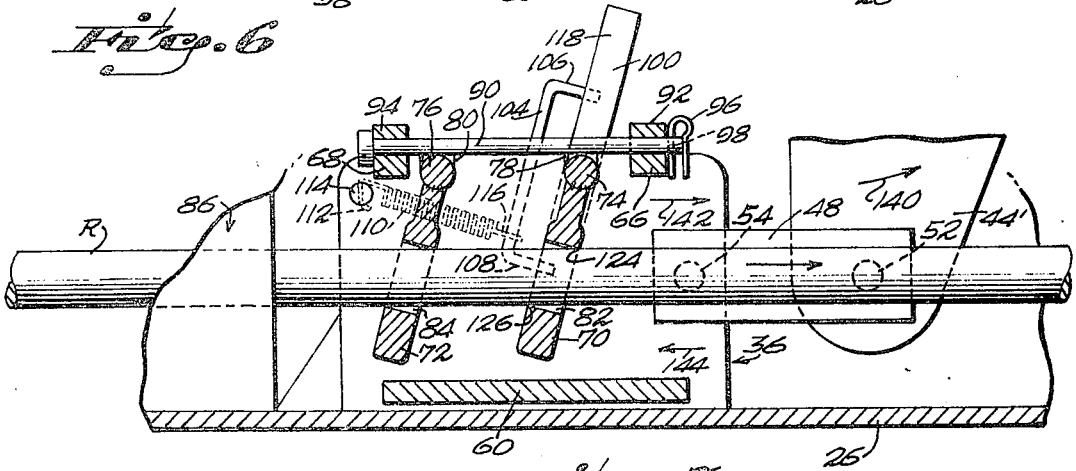
FIG. 7 is a longitudinal sectional view similar to FIG. 6, illustrating the drive jaws in a second position.

As best seen in FIGS. 5, 6 and 7, an elongated keeper rod 90, having a head 91 on one end, is passed through holes in a pair of aligned, upwardly extending, centrally disposed bosses 92 and 94 from the respective transverse connecting bars 66 and 68. Means such as the spring clip 96 is passed through a hole 98 in the extended end of keeper rod 90.

The jaws 70 and 72 are provided with respective shift levers 100 and 102 fixed as by welding relative to one extended end of each pivot rod 74 and 76. The levers 100 and 102 are disposed outwardly of the respective side walls 56 and 58. As both jaw assemblies function in the same manner, the ensuing description will be directed to the operation of lever arm 100 and jaw 70 as best detailed in FIGS. 6 and 7.

The lever 100 as previously stated is fixed rigidly to pivot rod 74 of jaw 70 and a slide rod 104 is disposed rearwardly along the main central length of lever 100 in a spaced relation therefrom. Inwardly turned upper and lower leg portions 106 and 108 of slide rod 104 are fixed as by welding to the lever 100. As best illustrated in FIGS. 6 and 7, the slide rod 104 vertically spans the axis of the jaw pivot rod 74. A tension spring 110 has a first end 112 connected to a pin 114 fixed relative to the upper rear edge of slide box side wall 56, and a second end 116, slidably engaged with the slide rod 104. The inherent tension forces in spring 110 causes it to seek and hold the shortest possible span. Therefore, when the shift lever 100 is manually moved to the position of FIG. 6 by means of the top hand grip portion 118, the jaw 74 is angled as shown in FIG. 6 with the edges 120 and 122 of jaw hole 82 engaged against the rod R.

When the shift lever 100 is pivoted clockwisely to the position of FIG. 7, the jaw edges 124 and 126 engage the rod R as illustrated. As the lever 100 is being pivoted, the second end of spring 110 slides downwardly along slide rod 104 until it finds the shortest lower span possible. In this manner both jaws 70 and 72 may be shifted to the two positions illustrated in FIGS. 6 and 7 to accomplish a forward or reverse driving movement of rod R. The operation of jaw 72 and shift lever 102 is identical with the above description; the sliding movement of the tension spring 130 is the opposite to that of spring 110 only because the positioning of slide bar 132 and spring 130 are reversed for structural reasons.

In operation, for driving a rod such as R under a finished surface, a rod length R is positioned through the jaw holes 82 and 84 in a conventional manner, as illustrated. The hydraulic cylinder 34 is activated to draw the bell crank lever 28 upwardly in a counterclockwise direction as seen in FIG. 4. With reference to FIG. 7, this will cause lever arm 44, 44′ to move in the direction of arrow 140. Slide box 36 will therefore be moved in the direction of arrow 142 by means of links 48 and 50, causing the rod length R to be driven forwardly, in a first direction, into the soil under a finished surface because of the downward rearward inclination of the drive jaws 70 and 72. On the return stroke of piston 32, the slide box 36 will be driven in the reverse direction of arrow 144; the drive jaws 48 and 50, because of their angles of inclination, will drag loosely along rod R, not moving same.

When the angles of inclination of jaws 70 and 72 are reversed as in FIGS. 4, 5 and 6, the operation of said jaws will be reversed. The return or down stroke of piston 32 will cause the slide box 36 to move in the direction of arrow 150. The jaws 70 and 72 will drive the rod R in a reverse or second direction to withdraw the rod R from under the finished surface. This operation is performed after the rod R has penetrated into the target trench and the pipe to be installed under the finished surface has been coupled thereto. In this manner the pipe is withdrawn until it emerges into the operating trench 18.

To replace the jaws 70 and 72, the second ends such as 116 of tension springs 110 are removed from the slide rods such as 104, and the spring clip 96 and keeper rod 90 are removed. The drive jaw, pivot rod and lever assemblies may then be lifted from the notches 78—78 and 80—80. Replacement jaw assemblies may then be dropped into place in said notches, the tension spring 110 reattached to the slide rods 104, and the keeper rod 90 and spring clip 96 reengaged. In this manner, worn drive jaws can be replaced in a matter of minutes without removal or disassembly of the slide box 36.

I claim:

1. A reversable drive jaw means for use in combination with a pipe and rod pusher device of the type used to install a pipe under a finished driveway, street, etc., the drive jaw means being power actuated in a conventional manner by a bell crank lever pivoted relative to opposed, upstanding side walls of a generally channel shaped main body member of the device, the bell crank having a first lever arm pivotally attached to a piston rod which imparts reciprocating movement thereto, said drive jaw means comprising, A. at least one drive jaw assembly mounted relative to a pair of upstanding, spaced apart side walls of a slide box, slidably engaged longitudinally of a base portion of the main body member, a second arm of the bell crank being pivotally linked to one of said slide box to impart forward and reverse reciprocating movement thereto, said drive jaw assembly comprising, a. a generally rectangular, pivotal transverse jaw plate with a round central through hole somewhat enlarged relative to the diameter of a pipe or rod, normally passing longitudinally therethrough, b. a pivot rod, fixed across the top edge of said jaw plate, c. a pair of transversely aligned, upwardly opening notches in the upper edge portion of the respective slide box side walls to rotatably journal opposed extended ends of said pivotal rod, d. a longitudinally extending keeper rod removably fixed relative to said slide box in a manner so as to engage said pivot rod to maintain said opposed ends in said notches, e. a control lever rigidly fixed to one end of said pivot rod exteriorly of said slide box, f. a tension spring having a first end anchored to said slide box and a second end, selectively adjustable between points of engagement with said control lever above and below the point of attachment to said pivot rod.

2. The drive jaw means as defined in claim 1 wherein said control lever includes a slide bar fixed relative thereto to slidably journal said spring second end for movement between said points of engagement whereby said jaw plate is selectively angled and tensioned in a first direction to engage the pipe or rod passing therethrough in a manner so as to drive same in a forward direction upon operation of the bell crank, or angled in a second direction to engage and drive the pipe or rod in a reverse direction.

3. The drive jaw means as defined in claim 2 including a second drive jaw assembly, disposed in a spaced relation to said one drive jaw assembly to co-act therewith in driving the pipe or rod in said forward and reverse directions.

4. The drive jaw means as defined in claim 3 including a pair of connection bars, transversely fixed between the respective front and back top edge of said slide box side walls.

5. The drive jaw means as defined in claim 4 including an upwardly extending, centrally disposed boss from each of said connecting bars with axially aligned, longitudinally extending through holes therein to slidably receive said keeper rod.

6. The drive jaw assembly as defined in claim 5 wherein said keeper rod is removably maintained in place by an enlarged head on one end and a removable means such as a pin or spring clip engaged through a diametric hole in the opposed end.

* * * * *